United States Patent [19]

Kyle

[11] Patent Number: 4,514,590

[45] Date of Patent: Apr. 30, 1985

[54] ELECTRICAL TERMINAL ASSEMBLY

[76] Inventor: James C. Kyle, 610 Woodwillow St., Roseburg, Oreg. 97470

[21] Appl. No.: 433,528

[22] Filed: Oct. 8, 1982

[51] Int. Cl.[3] ..... H01B 17/26

[52] U.S. Cl. ..... 174/152 GM; 156/294; 403/179; 428/416

[58] Field of Search ..... 174/50.62, 151, 152 R, 174/152 GM, 153 R; 403/179; 428/416; 156/294, 330

[56] References Cited

U.S. PATENT DOCUMENTS

| | | | |
|---|---|---|---|
| 2,200,694 | 5/1940 | Gerecke et al. | 174/152 GM |
| 2,879,323 | 3/1959 | Nichols et al. | 174/182 X |
| 3,365,355 | 1/1968 | Netsch | 428/416 X |
| 3,539,430 | 11/1970 | Duryee | 174/152 R X |

FOREIGN PATENT DOCUMENTS

| | | | |
|---|---|---|---|
| 769452 | 3/1957 | United Kingdom | 174/151 |
| 1213458 | 11/1970 | United Kingdom | 174/152 R |

*Primary Examiner*—Laramie E. Askin

*Attorney, Agent, or Firm*—Ellsworth R. Roston; Charles H. Schwartz

[57] ABSTRACT

An insulating member formed from a suitable hydrocarbon such as polyether ether ketone may be molded into any desired shape at a temperature of approximately 700° F. and a suitable pressure of approximately 10,000–12,000 psi. An epoxy insulating material hermetically seals the insulating member to an electrically conductive member and a metallic housing. The insulating member and the epoxy insulating material maintain the hermetic seal through a suitable range of temperatures such as between ambient and approximately 400° F. and through a suitable range of pressures such as between atmospheric and approximately 60,000 psi. The epoxy insulating material is first applied to the surfaces of the conductive member and the metallic housing, one of these surfaces being preferably flat, and the insulating member is then inserted into the space between the conductive member and the metallic housing. The insulating member is then pushed toward the flat surface to cause the epoxy insulating material to flow between the insulating member and the housing and between the insulating member and the conductive member. The epoxy insulating material is then cured. A rigid insulating layer formed from metallic oxides may be applied to a second flat surface on one of the electrically conductive member and the metallic housing. Additional layers formed from the metallic oxides in different proportions to provide progressive flexibilities may be hermetically sealed to the rigid layer and to one another.

11 Claims, 5 Drawing Figures

Fig. 1
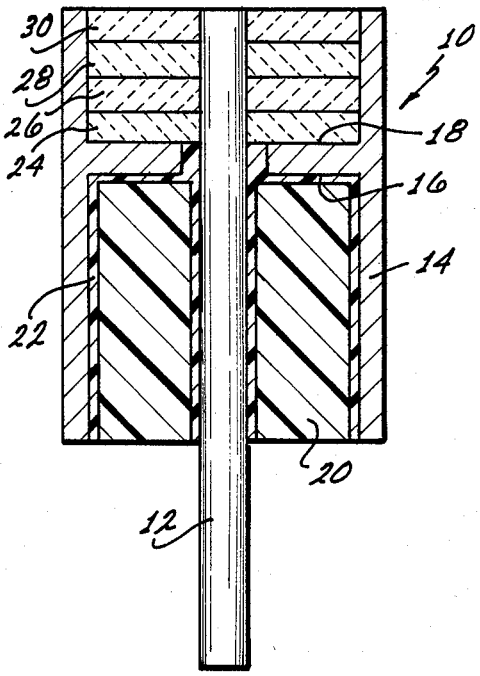
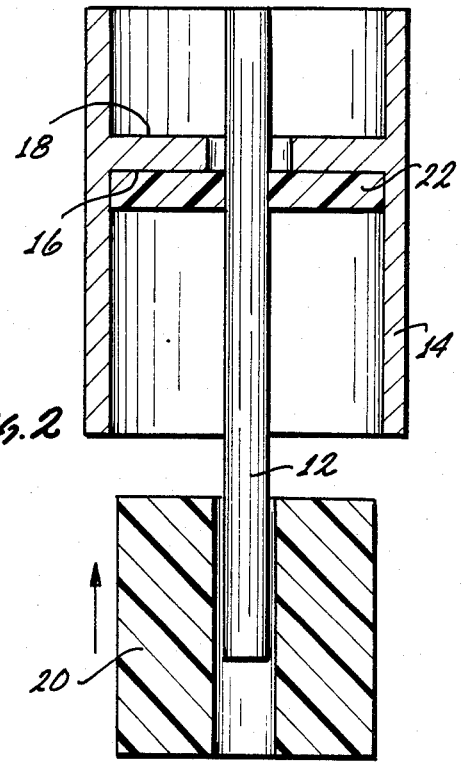
Fig. 2
Fig. 3
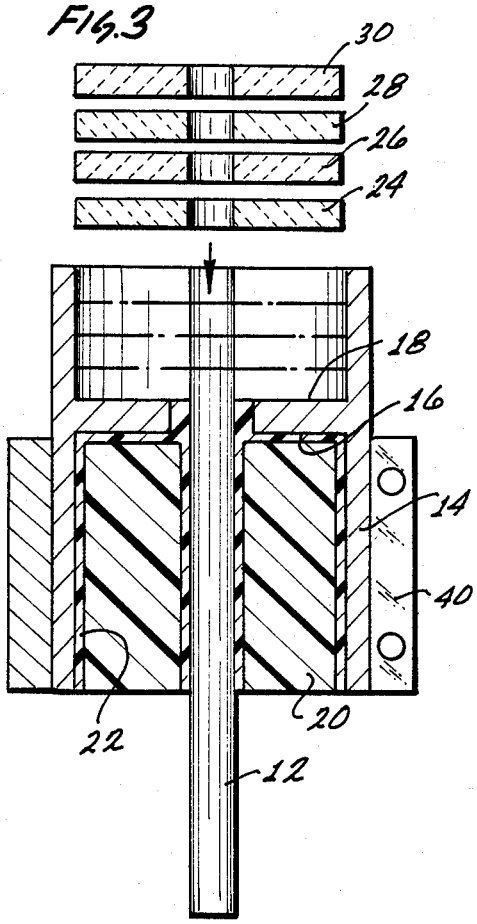
Fig. 4
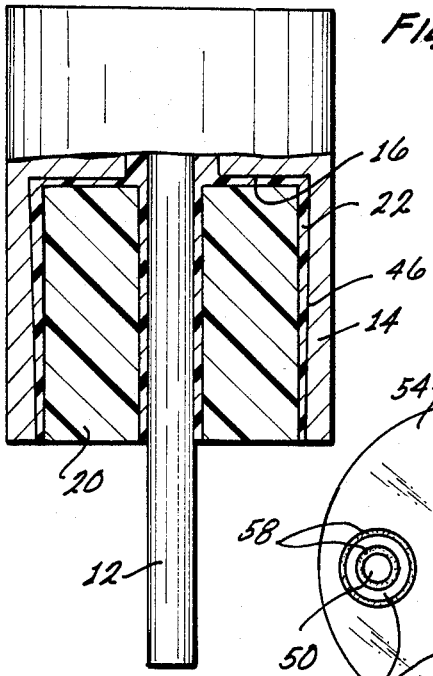
Fig. 5
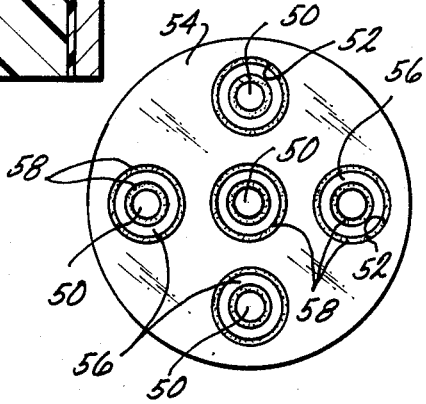

ELECTRICAL TERMINAL ASSEMBLY

This application relates to an electrical terminal assembly and to methods of manufacturing such a terminal assembly. More particularly, the invention relates to an electrical terminal assembly having properties facilitating its use in extreme conditions of temperature and pressure such as occur in deep oil wells. The invention also relates to methods of producing an electrical terminal which is capable of being used without any deterioration in such extreme conditions of temperature and pressure.

As oil near the surface of the earth becomes discovered and recovered, the search for new sources of oil has extended deeper and deeper into the earth. For example, it is now common to drill at depths five (5) miles below the surface of the earth. At such depths, the temperatures and pressures encountered become extreme. For example, temperatures in the order of several hundred degrees Fahrenheit and pressures in the order of tens of thousands of pounds per square inch have been frequently encountered at such depths.

It is time consuming and expensive to extend equipment in oil wells to depths of at least five (5) miles below the earth's surface. Because of this, it is important that the equipment disposed at such depths operate for extended periods of time without any deterioration or breakdown in its performance characteristics. If such equipment should deteriorate or break down at such depths, the equipment has to be raised to the earth's surface and the components in the equipment have to be replaced or repaired before the equipment can then be lowered to the operating depths. During the time that the equipment is being raised, repaired and lowered, an oil well generally has to remain inactive. This is quite expensive and time-consuming.

A considerable effort has been made over a substantial number of years to develop equipment such as electrical terminals which will be able to operate for extended periods of time, without any deterioration, at temperatures to several hundred degrees Fahrenheit and at pressures to tens of thousands of pounds per square inch. In spite of such effort, the electrical terminals now in use have not been able to withstand such extreme conditions for an extended period of time without any deterioration. As a result, a considerable time has been lost, and substantial money has been expended, in repairing or replacing such electrical terminals.

This invention provides an electrical terminal which produces a hermetic seal for extended periods of time without any deterioration even when the terminal is subjected to elevated temperatures as high as 400° F. and pressures as high as 60,000 psi. Even when subjected to such extreme conditions, the electrical terminal provides an electrical insulation of at least $10^{11}$ ohms for extended periods of time in the order of months and even years without any deterioration in the hermetic seal and without any decrease in the amount of electrical insulation provided. The electrical terminals of this invention are formed by relatively simple methods to provide the desired electrical properties.

In one embodiment of the invention, an electrically conductive member such as a rod or a pin and a metallic housing are hermetically sealed to each other to provide a high electrical insulation even at elevated temperatures and pressures. The hermetic seal includes an electrically insulating member preformed to be disposed between the electrically conductive member and the metallic housing. The insulating member may be formed from a suitable hydrocarbon such as a polyether ether ketone. The insulating member may be molded into any desired shape at a suitable temperature such as approximately 700° F. and at a suitable pressure such as in the range of approximately 10,000 to 12,000 psi.

Insulating material hermetically seals the insulating member to the electrically conductive member and the metallic housing. The insulating member and the insulating material maintain the hermetic seal and the insulating relationship between the terminal pin and the housing through a range of temperatures between ambient temperatures and approximately 400° F. and through a range of pressures between atmospheric pressure and pressures of approximately 60,000 psi.

The insulating material is first applied to the surfaces of the conductive member and the metallic housing, one of the surfaces being preferably flat, and the insulating member is then inserted into the space between the electrically conductive member and the metallic housing. The insulating member is then pushed toward the preferably flat surface to cause the insulating material to flow through all of the space between the insulating member and the housing and between the insulating member and the terminal pin. The insulating material is then cured for an extended period of time such as several hours. The curing preferably occurs in a vacuum such as $10^{-3}$ atmospheres while the different components in the terminal assembly are clamped to one another to maintain their preferred positions.

A rigid insulating layer may be applied to a second flat surface on one of the electrically conductive members and the metallic housing and may be formed from particular metallic oxides. Additional layers formed from particular oxides in different proportions may be hermetically sealed to the rigid layer and to one another and may be provided with progressive amounts of flexibility.

In the drawings:

FIG. 1 is a sectional view of one embodiment of an electrical terminal assembly constituting this invention;

FIG. 2 is a schematic view illustrating the relative disposition of the different parts in the embodiment of FIG. 1 in one step of a method for producing the electrical terminal; and FIG. 3 illustrates the relative disposition of the different components in another step of the invention;

FIG. 4 is a sectional view of a second embodiment of the invention; and

FIG. 5 is a plan view of a further embodiment of the invention.

In one embodiment of the invention, an electrical terminal generally indicated at 10 is provided. The electrical terminal includes a rod or terminal pin 12 preferably made from an electrically conductive material. The terminal pin 12 may be made from a stainless steel or a material designated by the trademark "Inconel". "Inconel" includes such metals as nickel, iron, cobalt, vanadium and chromium.

The terminal pin 12 is spaced from a housing 14 made from a suitable metal or alloy such as stainless steel or Inconel. The housing 14 is provided with a flat surface 16 which faces in one direction. The housing 14 also has a flat surface 18 which faces in a direction opposite to the flat surface 16. Although the flat surfaces 16 and 18 are shown as being provided on the housing 14, it will be appreciated that the terminal pin 12 may be provided with flat surfaces corresponding to the flat surfaces 16 and 18 on the housing and that the housing 14 may be spaced from these flat surfaces.

An insulating member 20 is disposed in the space between the terminal pin 12 and the housing 14. The insulating member 20 may be made from a suitable hydrocarbon such as a polyether ether ketone. Such a material is presently being marketed by ICI of Americas (located in Irvine, Cal.) under the trademark "PEEK". Such a material is desirable because it has a relatively high electrical insulation such as in the order of $10^{11}$ ohms.

The external surfaces of the insulating member 20 are disposed in adjacent relationship to the walls of the terminal pin 12 and the housing 14. Insulating material 22 is disposed in this space to hermetically seal the insulating member 20 to the terminal pin 12 and the housing 14. The insulating material may be a suitable material such as an epoxy. The epoxy material 22 is provided with characteristics of maintaining the hermetic seal through an extended range of temperatures between ambient temperatures and temperatures as high as 400° F. and through an extended range of pressures between atmospheric pressure and a pressure of at least 60,000 psi. The epoxy material 22 may be that designated as "Epoxylite" and is marketed by Epoxylite (located in Anaheim, Cal.).

A plurality of layers 24, 26, 28 and 30 are hermetically sealed to the flat surface 18 of the housing 14 and to one another. The layer 24 is provided with rigid characteristics. The layers 26, 28 and 30 are preferably made from oxides of the same elements but in different percentages to provide each of these layers with different flexibility characteristics than those of the other layers. For example, the layer 26 is provided with some flexibility, the layer 28 is provided with increased flexibility, and the layer 30 is provided with even greater flexibility. Although only three flexible layers 26, 28 and 30 are shown and described, it will be appreciated that any number of layers may be provided, each with a progressive flexibility characteristic relative to the layers closer to the rigid layer 24.

The layers 24, 26, 28 and 30 may be constructed in a manner such as disclosed and claimed in application Ser. No. 284,129 filed by me on July 16, 1981, for a "Terminal Assembly". As disclosed in copending application Ser. No. 284,129, filed July 16, 1981, layer 24 may be formed from the following materials in the following relative amounts by weight:

| Material | Relative Amount by Weight |
|---|---|
| Lead oxide (preferably red lead) | 41.0 |
| Zinc oxide | 3.0 |
| Alumina (preferably calcined) | 1.8 |
| Silicon dioxide | 27.0 |
| Cerium oxide | 0.9 |
| Lanthanum oxide | 2.7 |
| Cobalt oxide | 1.4 |
| Sodium antimonate | 7.2 |
| Zinc zirconium silicate | 2.7 |
| Bismuth trioxide | 9.0 |
| Molybdenum trioxide | 2.7 (but as low as 0.5% by weight) |

The layers 26, 28 and 30 may have the following composition:

| Oxide | Range of Percentages by Weight |
|---|---|
| Lead oxide (red lead) | 57–68 |
| Silicon dioxide | 23–32 |
| Soda ash (sodium carbonate) | 0.4–0.6 |
| Titanium dioxide | 3.2–3.9 |
| Zirconium oxide | 3.0–3.7 |
| Boric oxide | 2.2–2.6 |

The relative percentages of the different oxides in the layers 26, 28 and 30 cause the layers 30 and 28 to respectively have increased coefficients of thermal expansion relative to the coefficients of thermal expansion of the layers 26 and 24. This causes the layers 30 and 28 to respectively compensate more easily than the layers 26 and 24 for any stresses in the terminal assembly as a result of changes in temperature. Furthermore, each successive ones of the layers 30, 28 and 26 provides a compensation of increased sensitivity because it has an increased coefficient of thermal expansion in comparison to the coefficient of the layers below it in FIG. 1. This increased sensitivity for each layer can be particularly obtained because the layer 24 provides a thermal stability relative to the terminal pin 12 and the housing 14. This results from the fact that the coefficient of thermal expansion of the layer 24 changes at substantially the same rate as the coefficient of thermal expansion of the terminal pin 12 and the housing 14 with changes in temperature.

The insulating member 20 may be formed from a granulated powder which is molded at an elevated temperature such as approximately 700° F. and at a relatively high pressure such as 10,000 to 12,000 psi. The insulating member 20 is formed in molds which are oil heated so as to be certain that the member 20 is moisture free. The molded member 20 is then inserted into the space between the terminal pin 12 and the housing 14.

The flat surface 16 of the housing 14 is initially coated with the insulating material 22. When the insulating member 20 is inserted into the space between the terminal pin 12 and the housing 14, the insulating material 22 adjacent the flat surface 16 is forced to flow along the flat surface 16 and downwardly in the space between the insulating member 20 and the terminal pin 12 and between the insulating member 20 and the housing 14. The flat surface 16 facilitates the displacement of the insulating material 22 into the space between the insulating member 20 and the terminal pin 12 and between the insulating member 20 and the housing 14. This displacement occurs without the formation of any bubbles in the space occupied by the insulating material 22.

The terminal assembly 10 is then disposed in a vacuum chamber for an extended period of time such as twelve (12) hours. The vacuum chamber may be provided with a suitable vacuum such as $10^{-3}$ atmospheres. The vacuum is instrumental in eliminating any bubbles in the insulating material 22 and in providing for a uniform displacement of the insulating material into the space between the insulating member 20 and the terminal pin 12 and between the insulating member 20 and the housing 14.

The different parts in the terminal assembly 10 may be maintained in clamped relationship, as at 40, during the time that a vacuum is applied to the terminal assembly. This helps to eliminate any bubbles in the insulating material 22. The clamping arrangement is also maintained during the time that the insulating material is cured. This curing may occur during an extended period of time such as approximately seven (7) hours at an elevated temperature such as 390° F.

The layers 24, 26, 28 and 30 are formed in the terminal assembly 10 before the insertion of the insulating member 20 into the space between the terminal pin 12 and the housing 14. The layers 24, 26, 28 and 30 are preferably formed at this time since they require higher temperatures to become fused to the terminal pin 12 and the housing 14 than the temperatures required to produce the hermetic seal involving the insulating material 22. The method of forming the layers 24, 26, 28 and 30 and hermetically sealing these layers to one another and to the terminal pin 12 and the housing 14 is fully disclosed in copending application Ser. No. 284,129 filed July 16, 1981.

The terminal assembly described above has certain important advantages. One advantage is that it continues to be hermetically sealed through a range of temperatures between ambient temperatures and temperatures as high as approximately 400° F. and through a range of pressure between atmospheric pressure and pressures as high as approximately 60,000 psi. Another advantage is that it provides a high electrical insulation between the terminal pin 12 and the housing 14 through such range of temperatures and pressures. For example, the insulating member 20 and the insulating material 22 provide an electrical insulation as high as $10^{11}$ ohms through such extended ranges of temperatures and pressures. The terminal assembly is also able to withstand explosive charges that are produced to initiate a recovery of the oil from the oil wells.

The layers 24, 26, 28 and 30 also cooperate with the insulating member 12 and the housing 14 in providing the advantages discussed above. This results from the fact that the layer 24 is able to withstand mechanical forces such as from explosive charges and the layers 26, 28 and 30 are able to withstand stresses such as result from changes in temperature.

The ability of the layer 22 to withstand stresses from explosive charges and from temperature changes is facilitated by the disposition of the layer on the flat surface 16. The ability of the layers 24, 26 and 28 to withstand stresses from changes in temperature results in part from the progressive flexibility characteristics provided for the layers 26, 28 and 30. These progressive flexibility characteristics inhibit any cracks produced in any of these layers from propagating through that layer or any of the other layers.

The provision of the flat surfaces 16 and 18 in the sealing of the insulating members and layers to these surfaces also offers other advantages. For example, the flat surfaces 16 and 18 inhibit the formation of dendrites since they define sharp angles with the terminal pin 10 and the housing 14. These sharp angles are advantageous since dendrites cannot turn sharp corners.

FIG. 4 illustrates a modification of the terminal assembly shown in FIG. 1. In the modification shown in FIG. 4, the housing 14 is provided with a surface 46 which is slightly tapered. This taper facilitates the proper disposition of the insulating member 20 relative to the terminal pin 12 and the housing 14 and further provides for an enhanced flow of the insulating material through the space between the insulating member 20 and the surface 46.

Although only a single terminal pin is shown in FIGS. 1 through 4 and is described above, it will be appreciated that more than one terminal pin may be provided as shown in FIG. 5. In FIG. 5, each terminal pin 50 extends through a bore 52 in a housing 54. An insulating member 56 is disposed within each bore 52. Insulating material 58 corresponding to the insulating material 22 hermetically seals each terminal pin 50 to the insulating member 56 and hermetically seals the insulating member 56 to the housing 54.

Although this invention has been disclosed and illustrated with reference to particular applications, the principles involved are susceptible of numerous other applications which will be apparent to persons skilled in the art. The invention is, therefore, to be limited only as indicated by the scope of the appended claims.

I claim:

1. In combination, a member having properties of conducting electricity, an insulating member made from a hydrocarbon material and providing an electrical insulation in a temperature range between ambient temperature and temperatures of approximately 400° F. and in a pressure range between atmospheric pressure and pressures of at least 60,000 psi, and a sealing material having electrically insulating properties through the range of temperatures between ambient and approximately 400° F. and through the range of pressures between atmospheric and at least 60,000 psi and hermetically sealing the electrically conductive member and the insulating member and retaining this hermetic seal in the temperature range between ambient temperature and approximately 400° F. and in the pressure range between atmospheric pressure and at least 60,000 psi, the sealing material being made from an epoxy, the electrically conductive member being provided with a first flat surface and the insulating member being disposed adjacent the first flat surface and the sealing material being disposed at the first flat surface between the electrically conductive member and the insulating member to seal the electrically conductive member and the insulating member hermetically, a second flat surface on the electrically conductive member opposite the first flat surface, the electrically conductive member having a particular coefficient of thermal expansion, and means disposed on the second flat surface for providing an electrical insulation and hermetically sealed to the second flat surface and having substantially the particular coefficient of thermal expansion.

2. A combination as set forth in claim 1 wherein the hydrocarbon material is polyether ether ketone.

3. In combination, a member having properties of conducting electricity, an insulating member made from a hydrocarbon material having properties of providing an electrical insulation in a temperature range between ambient temperature and temperatures of approximately 400° F. and in a pressure range between atmospheric pressure and pressures of at least 60,000 psi, and a sealing material hermetically sealing the electrically conductive member and the insulating member in the temperature range between ambient temperature and approximately 400° F. and in the pressure range between atmospheric pressure and at least 60,000 psi, the sealing material being made from an epoxy, the electrically conductive member being provided with a first flat surface and the insulating member being disposed adjacent the first flat surface, the electrically conductive member being provided with a second flat surface opposite to the first flat surface, and layers of insulating material of progressive flexibility characteristics being disposed against the second flat surface on the electrically conductive member and being hermetically sealed to the second flat surface and to one another.

4. The combination set forth in claim 3 wherein the insulating member has an electrical resistivity of approximately $10^{11}$ ohms.

5. A combination as set forth in claim 3 wherein, the hydrocarbon material is polyether ether ketone.

6. In combination, an electrically conductive member, a metallic housing enveloping the electrically conductive member in spaced relationship to the electrically conductive member, a hydrocarbon insulating member disposed between the electrically conductive member and the metallic housing and having properties of providing an electrical insulation, in a range of temperatures between ambient temperature and approximately 400° F. and in a range of pressures between atmospheric pressure and pressures of several tens of thousands of pounds per square inch, a sealing material having electrically insulating properties through the range of temperatures between ambient and approximately 400° F. and in the range of pressures between atmospheric and tens of thousands of pounds per square inch and hermetically sealing the insulating member to the electrically conductive member and the metallic housing, the sealing material maintaining the hermetic seal, and providing electrical insulation, between the electrically conductive member and the metallic housing in a range of temperatures between ambient temperature and approximately 400° F. and in a range of pressures between atmospheric pressure and pressures to several tens of thousands of pounds per square inch, the housing having first and second surfaces and the insulating member being disposed adjacent the first surface of the housing in hermetically sealed relationship to the first surface of the housing, and means disposed adjacent the second surface of the housing in hermetically sealed relationship with the electrically conductive member and the housing for providing an electrical insulation, the means for providing an electrical insulation, the electrically conductive member and the housing having substantially the same coefficient of thermal expansion.

7. A combination as set forth in claim 6 wherein the hydrocarbon insulating member is made from polyether ether ketone.

8. In combination, an electrically conductive member, a metallic housing spaced from the electrically conductive member and having first and second opposite surfaces, there being a first flat surface on at least one of the electrically conductive member and the first surface of the metallic housing and the second surface on the metallic housing being flat, an insulating member disposed adjacent the first flat surface and adjacent the electrically conductive member and the metallic housing and having properties of providing an electrical insulation of at least $10^{11}$ ohms through a temperature range between ambient temperature and temperatures of approximately 400° F. and pressures between atmospheric pressure and pressures of approximately 60,000 psi, a first insulating material having electrically insulating properties through the range of temperatures between ambient temperature and temperatures of approximately 400° F. and the range of pressures between atmospheric pressure and pressures of approximately 60,000 psi and hermetically sealing the insulating member to the electrically conductive member and the metallic housing through the range of temperatures between ambient temperature and temperatures of approximately 400° F. and the range of pressures between atmospheric pressure and pressures of approximately 60,000 psi, a second material having rigid and electrically insulating properties and disposed adjacent the second flat surface and hermetically sealed to the second flat surface and the electrically conductive member and the metallic housing and made from a combination of oxides of particular metals, and progressive layers of insulating material sealed to the second insulating material and to one another and made from a combination of oxides of particular metals in different proportions to provide such layers with progressive amounts of flexibility.

9. The combination set forth in claim 8 wherein:

the insulating member and the first insulating material are made from hydrocarbons and the surface of the metallic housing adjacent the insulating member is tapered to facilitate the formation of a hermetic seal by the first insulating material between the metallic housing and the insulating member.

10. The combination set forth in claim 8 wherein:

the insulating member is formed from a polyether ether ketone and the first insulating material is an epoxy and the progressive layers are made from oxides of lead, silicon, sodium, titanium, zirconium and boron.

11. The combination set forth in claim 10 wherein:

the metallic housing is provided with a tapered surface and the insulating member is disposed in contiguous relationship to this tapered surface and the first insulating material hermetically seals the metallic housing and the insulating member at the tapered surface.

* * * * *